US011828294B2

(12) United States Patent
Tomioka et al.

(10) Patent No.: US 11,828,294 B2
(45) Date of Patent: Nov. 28, 2023

(54) PROPELLER FAN AND AIR CONDITIONER

(71) Applicant: DAIKIN INDUSTRIES, LTD., Osaka (JP)

(72) Inventors: Hirotaka Tomioka, Osaka (JP); Takahiro Yamasaki, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 18/212,616

(22) Filed: Jun. 21, 2023

(65) Prior Publication Data

US 2023/0349390 A1 Nov. 2, 2023

Related U.S. Application Data

(63) Continuation of application No. PCT/JP2021/042937, filed on Nov. 24, 2021.

(30) Foreign Application Priority Data

Jan. 21, 2021 (JP) ..... 2021-007658

(51) Int. Cl.
*F04D 29/38* (2006.01)
*F04D 29/66* (2006.01)
*F24F 7/007* (2006.01)

(52) U.S. Cl.
CPC ..... *F04D 29/386* (2013.01); *F04D 29/667* (2013.01); *F24F 7/007* (2013.01)

(58) Field of Classification Search
CPC ..... F04D 29/38; F04D 29/384; F04D 29/386; F04D 29/667; F04D 19/002; F24F 7/007
See application file for complete search history.

(56) References Cited

U.S. PATENT DOCUMENTS 8,915,717 B2 * 12/2014 Stephan ..... F04D 29/384 416/243
10,605,269 B2 * 3/2020 Stadler ..... F04D 29/164
(Continued)

FOREIGN PATENT DOCUMENTS

CN 204175642 U 2/2015
JP 2018-53749 A 4/2018
(Continued)

OTHER PUBLICATIONS

International Preliminary Report on Patentability and English translation of the Written Opinion of the International Searching Authority for International Application No. PCT/JP2021/042937, dated Jul. 20, 2023.
(Continued)

*Primary Examiner* — David E Sosnowski
*Assistant Examiner* — Jackson N Gillenwaters
(74) *Attorney, Agent, or Firm* — Birch, Stewart, Kolasch & Birch, LLP

(57) ABSTRACT

A propeller fan includes a hub, and a plurality of wings provided at an outer circumference of the hub. Each of the wings includes a protrusion tapered and positioned on a rotation direction rear side in a radially outer portion of the wing, the protrusion includes a top positioned at a rearmost end in the rotation direction, an outer circumferential rear edge positioned radially outside the top, and an inner circumferential rear edge positioned radially inside the top, the outer circumferential rear edge includes a first serration having a first serration shape, and the inner circumferential rear edge includes a second serration having a second serration shape.

4 Claims, 8 Drawing Sheets

(56) References Cited

U.S. PATENT DOCUMENTS

| | | | | |
|---|---|---|---|---|
| 2015/0240645 | A1 | 8/2015 | Yokose et al. | |
| 2018/0087784 | A1 | 3/2018 | Sawada | |
| 2019/0120253 | A1* | 4/2019 | Nakashima | F04D 29/384 |
| 2020/0040736 | A1 | 2/2020 | Teramoto et al. | |
| 2020/0173284 | A1* | 6/2020 | Gauss | F04D 29/384 |

FOREIGN PATENT DOCUMENTS

| | | | |
|---|---|---|---|
| WO | WO 2014/050146 | A1 | 4/2014 |
| WO | WO 2018/198300 | A1 | 11/2018 |

OTHER PUBLICATIONS

International Search Report for PCT/JP2021/042937 (PCT/ISA/210) dated Jan. 18, 2022.

* cited by examiner

PROPELLER FAN AND AIR CONDITIONER

CROSS REFERENCE TO RELATED APPLICATIONS

This application is a Continuation of PCT International Application No. PCT/JP2021/042937, filed on Nov. 24, 2021, which claims priority under 35 U.S.C. 119(a) to Patent Application No. 2021-007658, filed in Japan on Jan. 21, 2021, all of which are hereby expressly incorporated by reference into the present application.

TECHNICAL FIELD

The present disclosure relates to a propeller fan and an air conditioner including the propeller fan.

BACKGROUND ART

There has been conventionally known a propeller fan including a hub and a plurality of wings provided on an outer circumferential surface of the hub, the propeller fan including a protrusion tapered and positioned on a rear side in a rotation direction in a radially outer portion of each of the wings (see, for example, PATENT LITERATURE 1). The propeller fan includes an outer circumferential rear edge provided radially outside a top of the protrusion, and an inner circumferential rear edge provided radially inside the top of the protrusion. The outer circumferential rear edge of the propeller fan is provided with a serration shape including a plurality of grooves, to reduce eddies generated at a rear edge radially outside the top of the protrusion.

CITATION LIST

[PATENT LITERATURE]

PATENT LITERATURE 1: Japanese Laid-Open Patent Publication No. 2018-53749

SUMMARY

The present disclosure provides a propeller fan including a hub, and a plurality of wings provided on an outer circumferential surface of the hub, in which each of the wings includes a protrusion tapered and positioned on a rear side in a rotation direction in a radially outer portion of the wing, the protrusion includes a top positioned at a rearmost end in the rotation direction, an outer circumferential rear edge positioned radially outside the top, and an inner circumferential rear edge positioned radially inside the top, the outer circumferential rear edge is provided with a first serration shape, and the inner circumferential rear edge is provided with a second serration shape.

DETAILED DESCRIPTION

Embodiments will be described hereinafter.

[Entire configuration of propeller fan]

Figure 1:
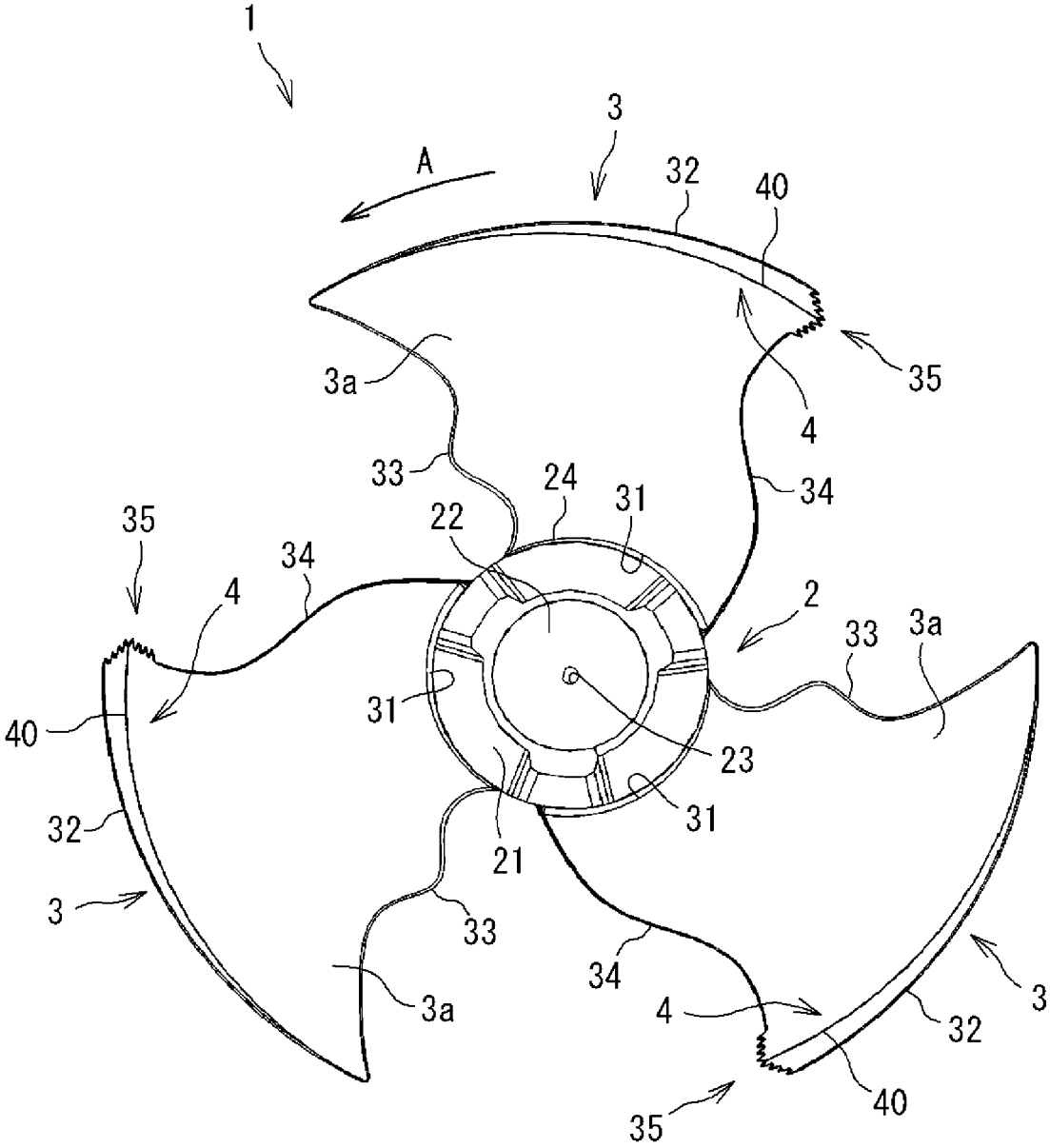
FIG. 1 is a schematic view from a first axial side, of a propeller fan according to the present disclosure.
Figure 2:
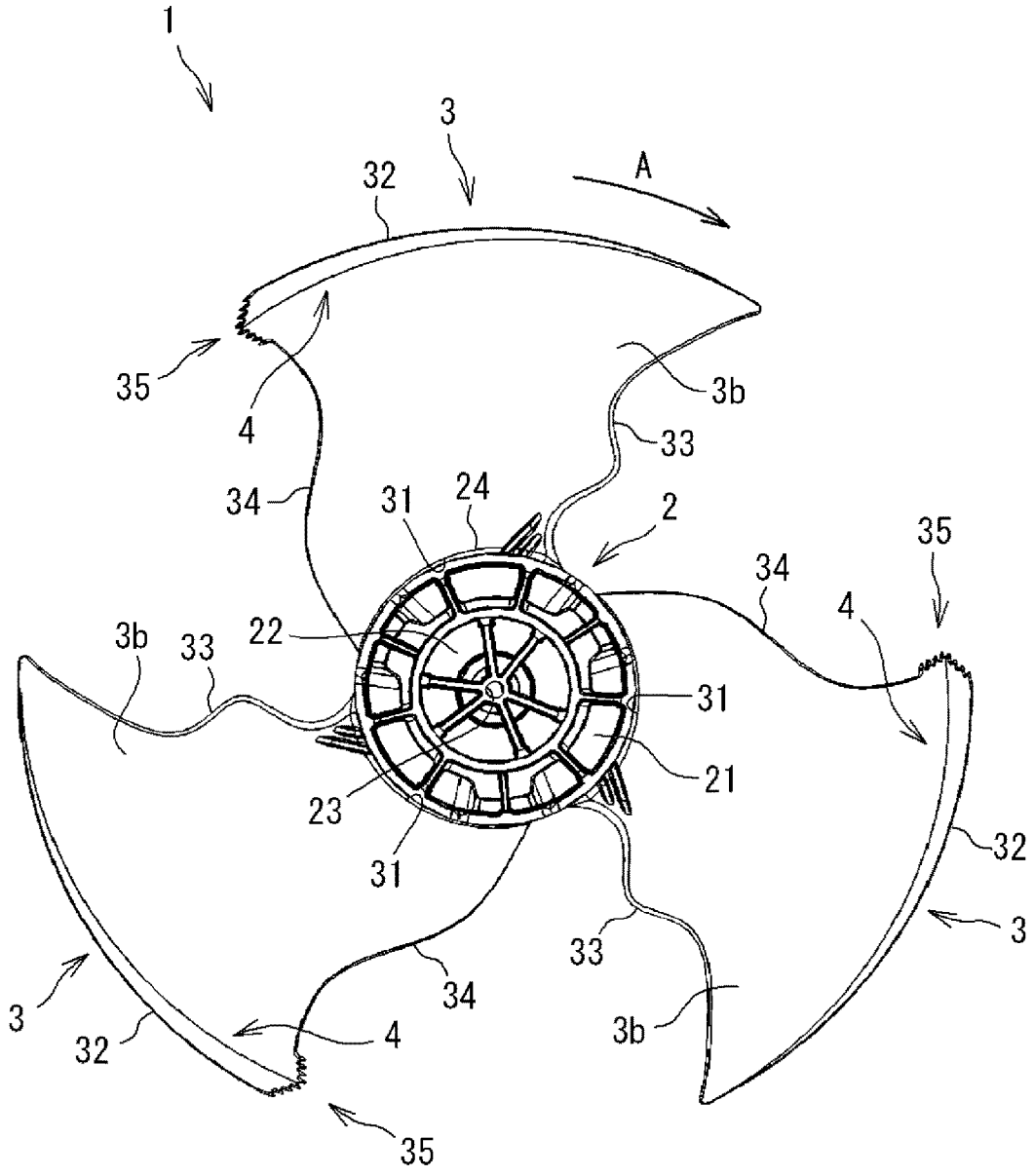
FIG. 2 is a schematic view from a second axial side, of the propeller fan according to the present disclosure.
Figure 3:
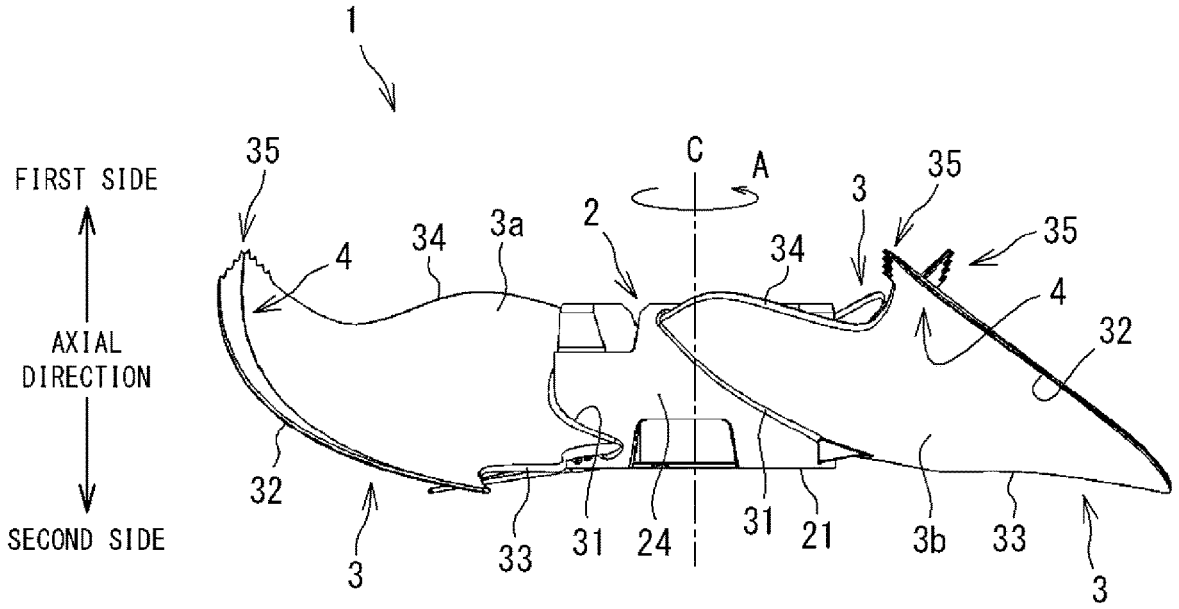
FIG. 3 is a schematic view in a direction perpendicular to the axial direction, of the propeller fan according to the present disclosure.

FIG. 1 to FIG. 3 depict a propeller fan 1 corresponding to a propeller fan according to an embodiment of the present disclosure. FIG. 1 is a view from a first axial side, of the propeller fan 1, and FIG. 2 is a view from a second axial side, of the propeller fan 1, in an axial direction along a center axis C (see FIG. 3) of the propeller fan 1. In this description, the direction of the center axis C of the propeller fan 1 and a direction parallel thereto will be defined as the axial direction, a direction perpendicular to the axial direction will be defined as a radial direction, and a direction about the center axis C will be defined as a circumferential direction.

As depicted in FIG. 1 to FIG. 3, the propeller fan 1 includes a hub 2 having a substantially cylindrical shape, and a plurality of wings 3. The hub 2 includes a cylindrical portion 21, and an end 22 sealing a first axial side of the cylindrical portion 21. The cylindrical portion 21 has an axial center matching the center axis C (see FIG. 3) of the propeller fan 1. The end 22 is provided with a shaft hole 23 into which a shaft 56*a* (see FIG. 8) of a fan motor 56 is fitted. The cylindrical portion 21 has an outer circumference 24 integrally provided with the plurality of wings 3 at predetermined circumferential intervals. The propeller fan 1 according to the present embodiment includes three wings 3, but the propeller fan according to the present disclosure has only to include two or more wings.

The propeller fan 1 is rotated counterclockwise (a direction indicated by an arrow A in FIG. 1 and FIG. 2) when viewed from the first axial side, correspondingly to rotation of the fan motor 56. In this description, with respect to a rotation direction of the propeller fan 1, a front side in the rotation direction will be referred to as a rotation direction front side and a rear side in the rotation direction will be referred to as a rotation direction rear side.

[Detailed shape of wings]

As depicted in FIG. 1 to FIG. 3, each of the wings 3 is formed into a plate shape, and includes an inner circumferential edge 31, an outer circumferential edge 32, a front edge 33, and a rear edge 34. The inner circumferential edge 31 corresponds to a radially inner end of the wing 3, and is inclined to the first axial side from the rotation direction front side toward the rear side in the rotation direction. The inner circumferential edge 31 is connected to the outer circumference 24. The outer circumferential edge 32 corresponds to a radially outer end of the wing 3, and is inclined to the first axial side from the rotation direction front side toward the rear side in the rotation direction. The outer circumferential edge 32 is larger in circumferential length than the inner circumferential edge 31. The front edge 33 corresponds to a rotation direction front end of the wing 3, and connects rotation direction front ends of the inner circumferential edge 31 and the outer circumferential edge 32. The rear edge 34 corresponds to a rotation direction rear end of the wing 3, and connects rotation direction rear ends of the inner circumferential edge 31 and the outer circumferential edge 32.

When the propeller fan 1 including the wings 3 thus shaped rotates about the center axis C in the direction indicated by the arrow A, the propeller fan 1 has negative pressure on the second axial side and positive pressure on the first axial side. When the propeller fan 1 rotates about the center axis C in the direction indicated by the arrow A, air accordingly flows from the second axial side to the first axial side. In this description, the wings 3 each have a wing surface on the first axial side referred to as a positive pressure surface 3*a* and a wing surface on the second axial side referred to as a negative pressure surface 3*b*.

The wings 3 are gently curved to the second axial side in the circumferential direction, and the positive pressure surface 3*a* is concave.

[Protrusion]

As depicted in FIG. 1 to FIG. 3, each of the wings 3 further includes a protrusion 35 in a radially outer portion of the rear edge 34. The protrusion 35 projects backward in the rotation direction from the rear edge 34, and is tapered backward in the rotation direction in an axial view (into a substantially triangular shape).

Figure 4:
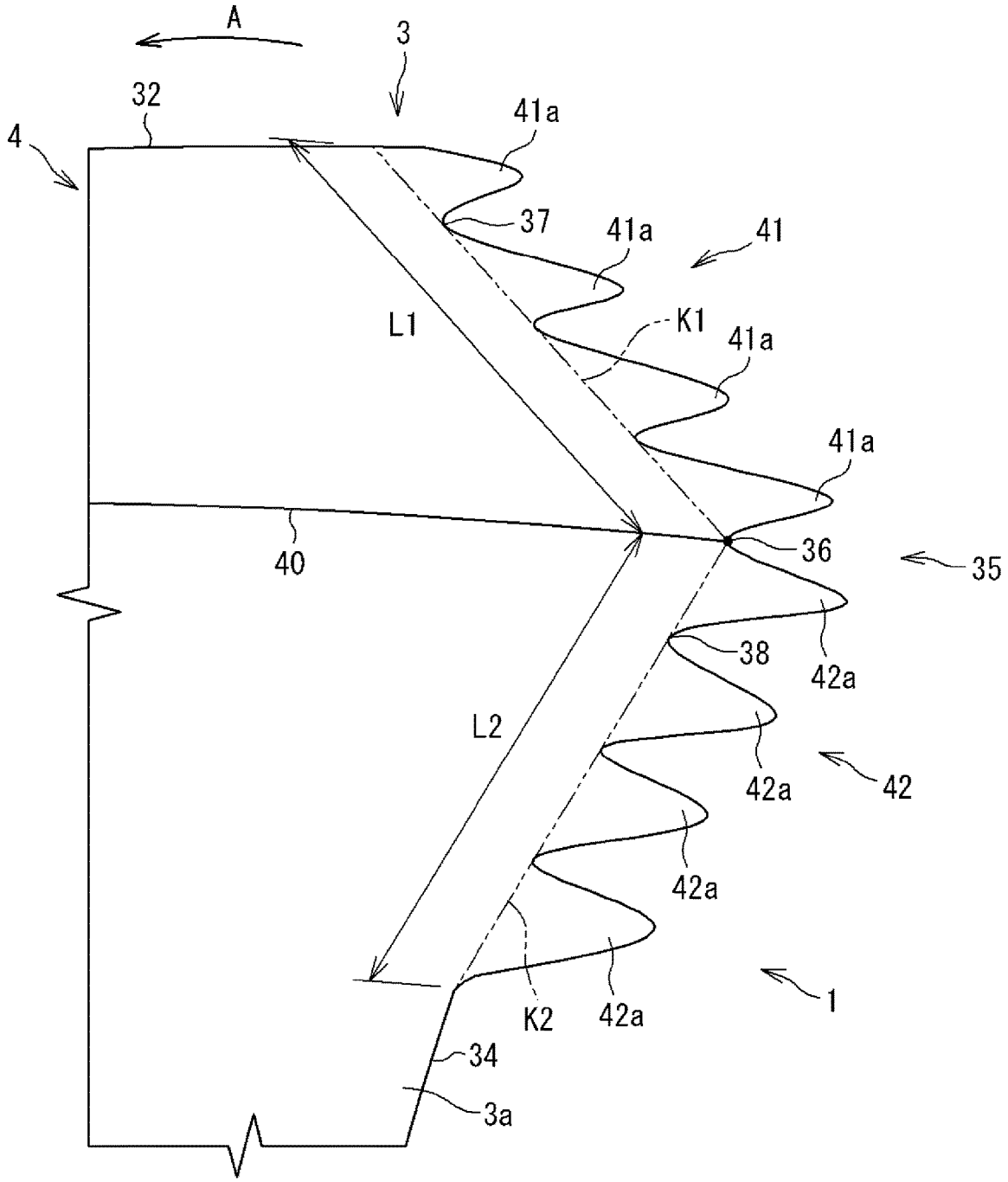
FIG. 4 is a partially enlarged schematic view of a protrusion of a wing.
Figure 5:
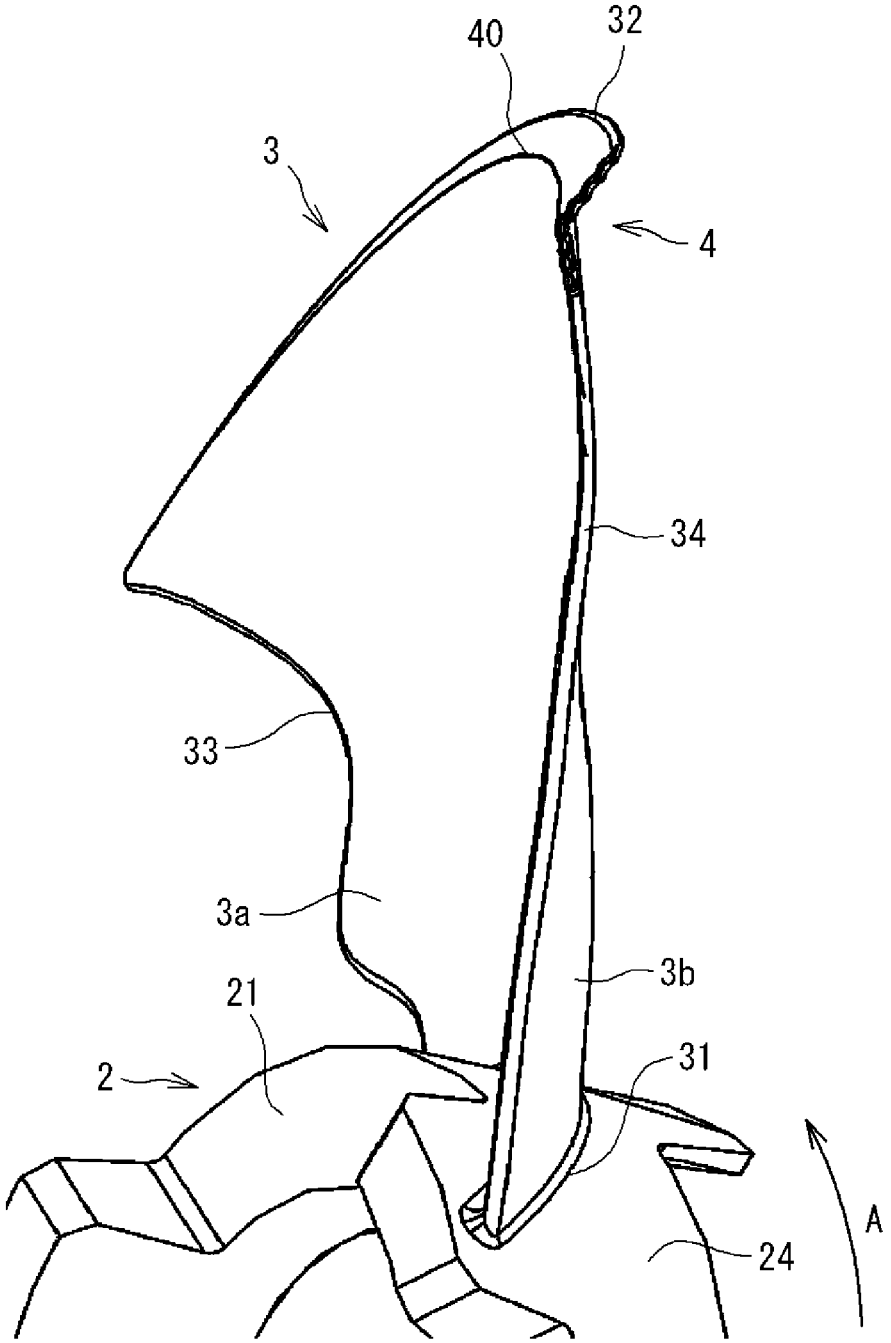
FIG. 5 is a partially enlarged perspective view of a bent portion of the wing.

FIG. 4 depicts the protrusion 35 viewed from the first axial side. As depicted in FIG. 4, the protrusion 35 includes a top 36, an outer circumferential rear edge 37 positioned radially outside the top 36, and an inner circumferential rear edge 38 positioned radially inside the top 36. The outer circumferential rear edge 37 is inclined in the axial view such that a radially outside is positioned ahead in the rotation direction of a radially inside. The inner circumferential rear edge 38 is inclined in the axial view such that a radially inside is positioned ahead in the rotation direction of a radially outside.

The top 36 is positioned to match an intersection point between a virtual line K1 indicating the position of the outer circumferential rear edge 37 (a straight line passing bottoms between convex portions 41*a*) and a virtual line K2 indicating the position of the inner circumferential rear edge 38 (a straight line passing bottoms between convex portions 42*a*).

The protrusion 35 includes a first serration 41 disposed at the outer circumferential rear edge 37. The first serration 41 is a portion having a first serration shape. The first serration shape is a sawteeth uneven shape formed by the plurality of convex portions 41*a* extending circumferentially and aligned radially. In other words, the first serration 41 corresponds to a portion provided with the convex portions 41*a* at the outer circumferential rear edge 37. The first serration 41 has a length L1 that is the length of the portion provided with the convex portions 41*a* at the outer circumferential rear edge 37.

The first serration shape at the first serration 41 is formed by four convex portions 41*a* provided along inclination of the outer circumferential rear edge 37. The present embodiment exemplifies the case where the first serration 41 includes the four convex portions 41*a*. The first serration in the propeller fan according to the present disclosure has only to have two or more (a plurality of) convex portions. The present embodiment exemplifies the case where the four convex portions 41*a* have substantially identical shapes (in terms of circumferential lengths and radial lengths). The first serration in the propeller fan according to the present disclosure includes the plurality of convex portions that may be identical or different in shape.

The protrusion 35 includes a second serration 42 disposed at the inner circumferential rear edge 38. The second serration 42 is a portion having a second serration shape. The second serration shape is a sawteeth uneven shape formed by the plurality of convex portions 42*a* extending circumferentially and aligned radially. In other words, the second serration 42 corresponds to a portion provided with the convex portions 42*a* at the inner circumferential rear edge 38. The second serration 42 has a length L2 that is the length of the portion provided with the convex portions 42*a* at the inner circumferential rear edge 38.

The second serration shape at the second serration 42 is formed by four convex portions 42*a* provided along inclination of the inner circumferential rear edge 38. The present embodiment exemplifies the case where the second serration 42 includes the four convex portions 42*a*. The second serration in the propeller fan according to the present disclosure has only to have two or more (a plurality of) convex portions. The present embodiment exemplifies the case where the four convex portions 42*a* have substantially identical shapes (in terms of circumferential lengths and radial lengths). The second serration in the propeller fan according to the present disclosure includes the plurality of convex portions that may be identical or different in shape.

[Bent portion]

As depicted in FIG. 1 to FIG. 3 and FIG. 5, each of the wings 3 further includes a bent portion 4 in the radially outer portion of the wing 3. The bent portion 4 is formed by bending the radially outer portion of the wing 3 to the second axial side, and includes a ridgeline 40. The ridgeline 40 extends circumferentially to be convex toward the positive pressure surface 3*a*. The bent portion 4 may alternatively be formed by curving the radially outer portion of the wing 3 to the second axial side so as to have a larger radius of curvature. The ridgeline 40 is radially round in this case.

In the wing 3 depicted in FIG. 4, the top 36 of the protrusion 35 is positioned on the ridgeline 40. Accordingly, in the wing 3, the outer circumferential rear edge 37 and the first serration 41 are positioned radially outside the ridgeline 40, and the inner circumferential rear edge 38 and the second serration 42 are positioned radially inside the ridgeline 40.

[Air flow at protrusion]

Figure 6:
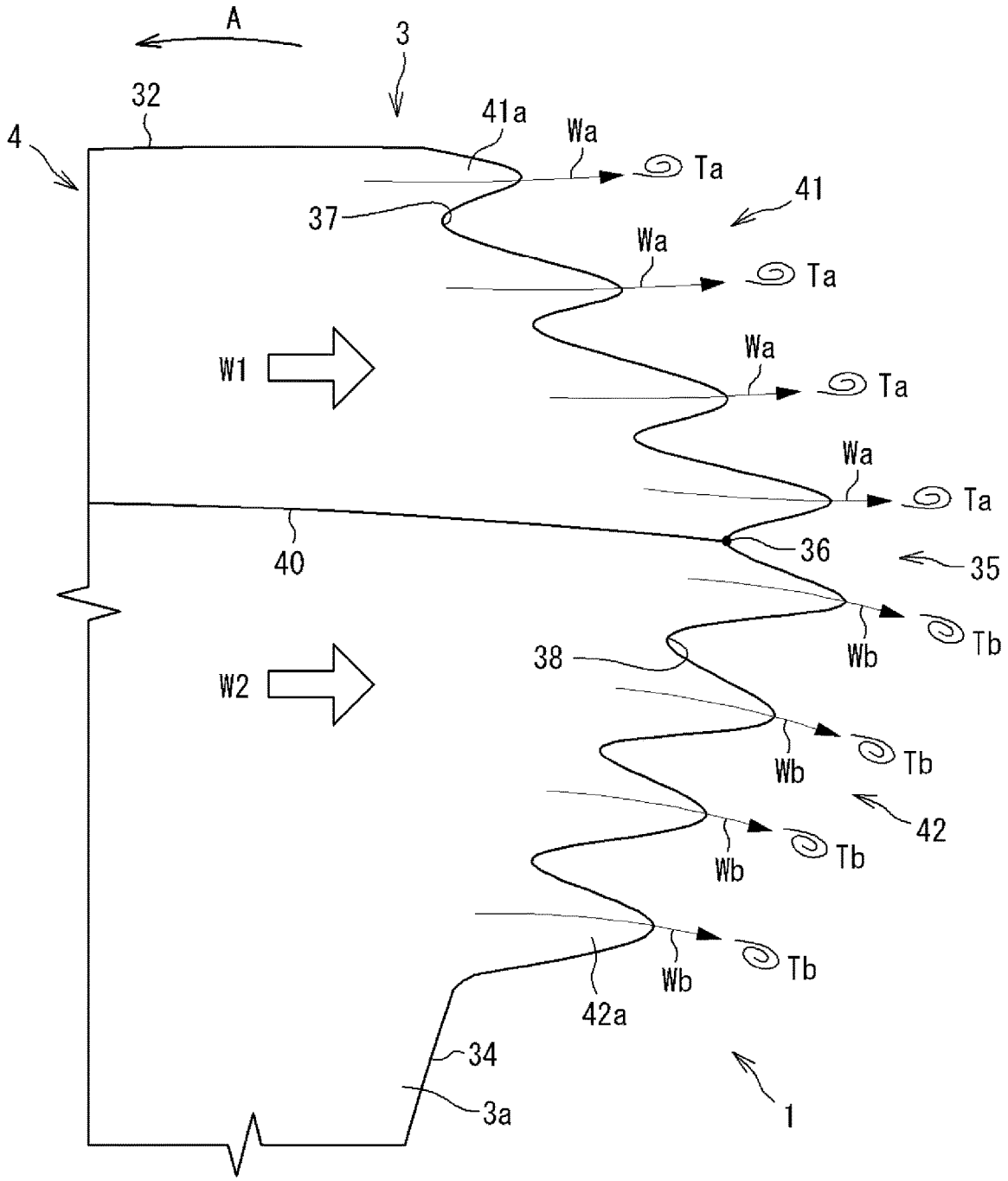
FIG. 6 is a schematic view indicating an air flow at the protrusion.

FIG. 6 indicates air flowing backward in the rotation direction from the protrusion 35 when the propeller fan 1 rotates about the center axis C (see FIG. 3) in the direction indicated by the arrow A. Rotation of the propeller fan 1 generates a circumferential air flow along the positive pressure surface 3*a*.

The propeller fan 1 includes the bent portion 4 including the ridgeline 40. Rotation of the propeller fan 1 accordingly generates a first air flow W1 flowing circumferentially along the positive pressure surface 3*a* radially outside the ridgeline 40, and a second air flow W2 flowing circumferentially along the positive pressure surface 3*a* radially inside the ridgeline 40.

The first air flow W1 flows backward in the rotation direction so as to be away from the positive pressure surface 3*a* at the outer circumferential rear edge 37. In this case, the first air flow W1 is divided into air flows Wa flowing backward in the rotation direction from the four convex portions 41*a*. This causes first eddies Ta due to the air flows Wa on the rear side in the rotation direction of the outer circumferential rear edge 37.

The convex portions 41*a* are smaller in radial length than the entirety of the outer circumferential rear edge 37. The first eddies Ta are thus smaller in size than eddies generated on the rear side in the rotation direction of the outer circumferential rear edge 37 from the first air flow W1 in a case where the first serration 41 is not provided.

The propeller fan 1 can have the first eddies Ta on the rear side in the rotation direction of the outer circumferential rear edge 37, to inhibit deterioration in fan efficiency due to eddies generated on the rear side in the rotation direction of the outer circumferential rear edge 37.

The second air flow W2 flows backward in the rotation direction so as to be away from the positive pressure surface 3*a* at the inner circumferential rear edge 38. In this case, the second air flow W2 is divided into air flows Wb flowing backward in the rotation direction from the four convex portions 42*a*. This causes second eddies Tb due to the air flows Wb on the rear side in the rotation direction of the inner circumferential rear edge 38.

Figure 7:
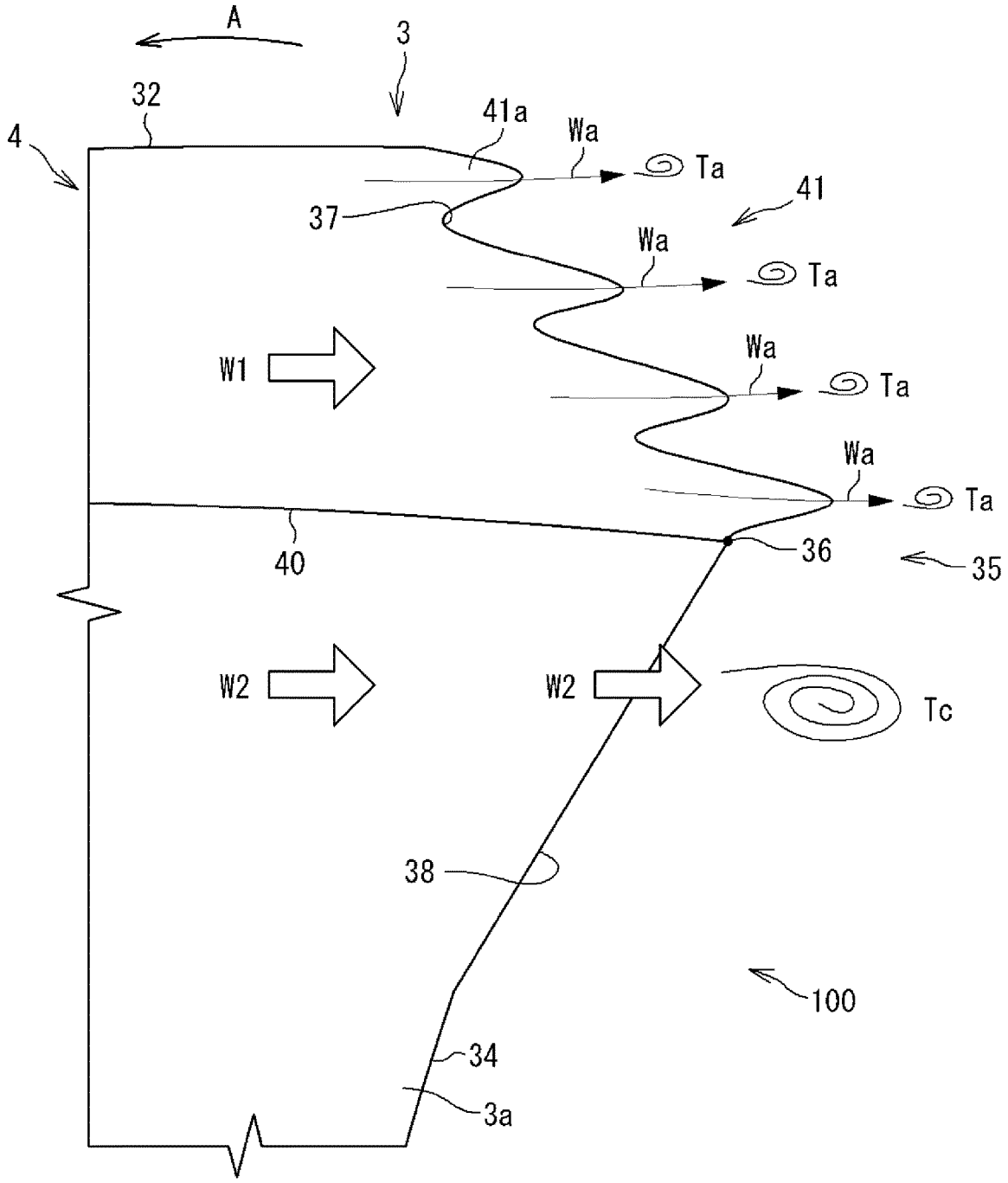
FIG. 7 is a partially enlarged schematic view of a protrusion provided with no second serration.

FIG. 7 depicts part of a virtual propeller fan 100 including the inner circumferential rear edge 38 not having the second serration, unlike the propeller fan 1 according to the present embodiment. The propeller fan 100 depicted in FIG. 7 is configured similarly to the propeller fan 1 except for that the second serration is not provided. In the propeller fan 100 depicted in FIG. 7, components configured in common with those in the propeller fan 1 are denoted by identical reference signs.

As depicted in FIG. 7, similarly to the propeller fan 1 according to the present embodiment, the propeller fan 100 has the first eddies Ta generated from the first air flow W1 on the rear side in the rotation direction of the outer circumferential rear edge 37. The propeller fan 100 does not have the second serration at the inner circumferential rear edge 38, and accordingly has eddies Tc, which are larger than the second eddies Tb, generated from the second air flow W2 on the rear side in the rotation direction of the inner circumferential rear edge 38.

As depicted in FIG. 6, the convex portions 42*a* in the propeller fan 1 are smaller in radial length than the entirety of the inner circumferential rear edge 38. The second eddies Tb are accordingly smaller in size than the eddies Tc.

The propeller fan 1 can have the second eddies Tb smaller in size than the eddies Tc on the rear side in the rotation direction of the inner circumferential rear edge 38. This can inhibit deterioration in fan efficiency due to the eddies Tb generated on the rear side in the rotation direction of the inner circumferential rear edge 38.

In the case where the inner circumferential rear edge 38 does not include the second serration as in the propeller fan 100 depicted in FIG. 7, the first eddies Ta and the eddies Tc interfere each other on the rear side in the rotation direction of the rear edge 34. When eddies interfere each other, increase in size of the eddies increases a level of interference between the eddies.

In the propeller fan 1 depicted in FIG. 6, both the eddies Ta and Tb generated on the rear side in the rotation direction of the outer circumferential rear edge 37 and the inner circumferential rear edge 38 are reduced in size to inhibit the level of interference between the eddies Ta and Tb, compared to the interference between the first eddies Ta and the eddies Tc. This can inhibit deterioration in fan static pressure efficiency due to interference between the eddies Ta and Tb generated on the rear side in the rotation direction of the rear edge 34 in the propeller fan 1.

As described above, the propeller fan 1 according to the present embodiment includes the hub 2, and the plurality of wings 3 provided at the outer circumference 24 of the hub 2. The wings 3 each include the protrusion 35 tapered and positioned on the rear side in the rotation direction in the radially outer portion of the wing 3, and the protrusion 35 includes the top 36 positioned at a rearmost end in the rotation direction, the outer circumferential rear edge 37 positioned radially outside the top 36, and the inner circumferential rear edge 38 positioned radially inside the top 36. The propeller fan 1 includes the first serration 41 provided at the outer circumferential rear edge 37 and having the first serration shape, and the second serration 42 provided at the inner circumferential rear edge 38 and having the second serration shape.

In the case where the propeller fan 1 thus configured includes the protrusion 35 tapered and positioned on the rear side in the rotation direction in the radially outer portion of each of the wings 3, this configuration can achieve reduction in size of both the eddies Ta and Tb generated at the outer circumferential rear edge 37 and the inner circumferential rear edge 38 of the protrusion 35. This enables reduction in level of interference between the eddies Ta and Tb generated at the outer circumferential rear edge 37 and the inner circumferential rear edge 38, to achieve improvement in fan efficiency of the propeller fan 1 in comparison to the propeller fan (see FIG. 7) not including the second serration 42.

The propeller fan 1 reduces the level of interference between the eddies Ta and Tb generated at the outer circumferential rear edge 37 and the inner circumferential rear edge 38, to further achieve reduction in fan noise in comparison to the propeller fan (see FIG. 7) not including the second serration 42.

Each of the wings 3 in the propeller fan 1 includes the bent portion 4 extending in the rotation direction in the radially outer portion of the wing 3, and the top 36 of the protrusion 35 is positioned on the ridgeline 40 of the bent portion 4. In the case where the propeller fan 1 thus configured includes the bent portion 4 at the outer circumferential edge 32, this configuration can achieve reduction in size of both the eddies Ta and Tb generated at the rear end (the outer circumferential rear edge 37) of the outer circumferential edge 32 and the rear end (the inner circumferential rear edge 38) radially inside the outer circumferential edge 32.

The present embodiment exemplifies the propeller fan 1 including the bent portion 4. Regardless of whether or not the bent portion 4 is provided, the propeller fan 1 including the protrusion 35 has the first air flow W1 flowing backward in the rotation direction from the outer circumferential rear edge 37 and the second air flow W2 flowing backward in the rotation direction from the inner circumferential rear edge 38. Accordingly, the propeller fan according to the present disclosure may alternatively include no bent portion.

[Regarding length of second serration]

A test was executed while changing a ratio of the length L2 of the second serration 42 to the length L1 of the first serration 41, to find that the effect of reduction in size of the eddies generated on the rear side in the rotation direction of the inner circumferential rear edge 38 changes as follows.

1) When the length L2 is less than 0.5 times the length L1, the effect is not achieved sufficiently.

2) The effect achieved when the length L2 is more than 2.0 times the length L1 is substantially equal to the effect achieved when the length L2 is 2.0 times the length L1.

3) The effect is the highest when the length L2 is at least 0.8 times and at most 1.2 times the length L1.

The test revealed that the length L2 is preferably at least 0.5 times and at most 2 times the length L1, and more preferably at least 0.8 times and at most 1.2 times the length L1.

As depicted in FIG. 4, at the protrusion 35 in the propeller fan 1 according to the present embodiment, the length L1 of the first serration 41 and the length L2 of the second serration 42 are substantially equal to each other, and the length L2 is accordingly at least 0.8 times and at most 1.2 times the length L1.

In this manner, in the propeller fan 1 according to the present embodiment, the length L2 of the second serration 42 is at least 0.5 times and at most 2 times the length L1 of the first serration 41, and is further at least 0.8 times and at most 1.2 times the length L1 of the first serration 41. The propeller fan 1 thus configured can achieve reduction in size of both the eddies Ta and Tb generated at the outer circumferential rear edge 37 and the inner circumferential rear edge 38.

[Air conditioner]

Description is made hereinafter to an air conditioner including the propeller fan 1.

Figure 8:
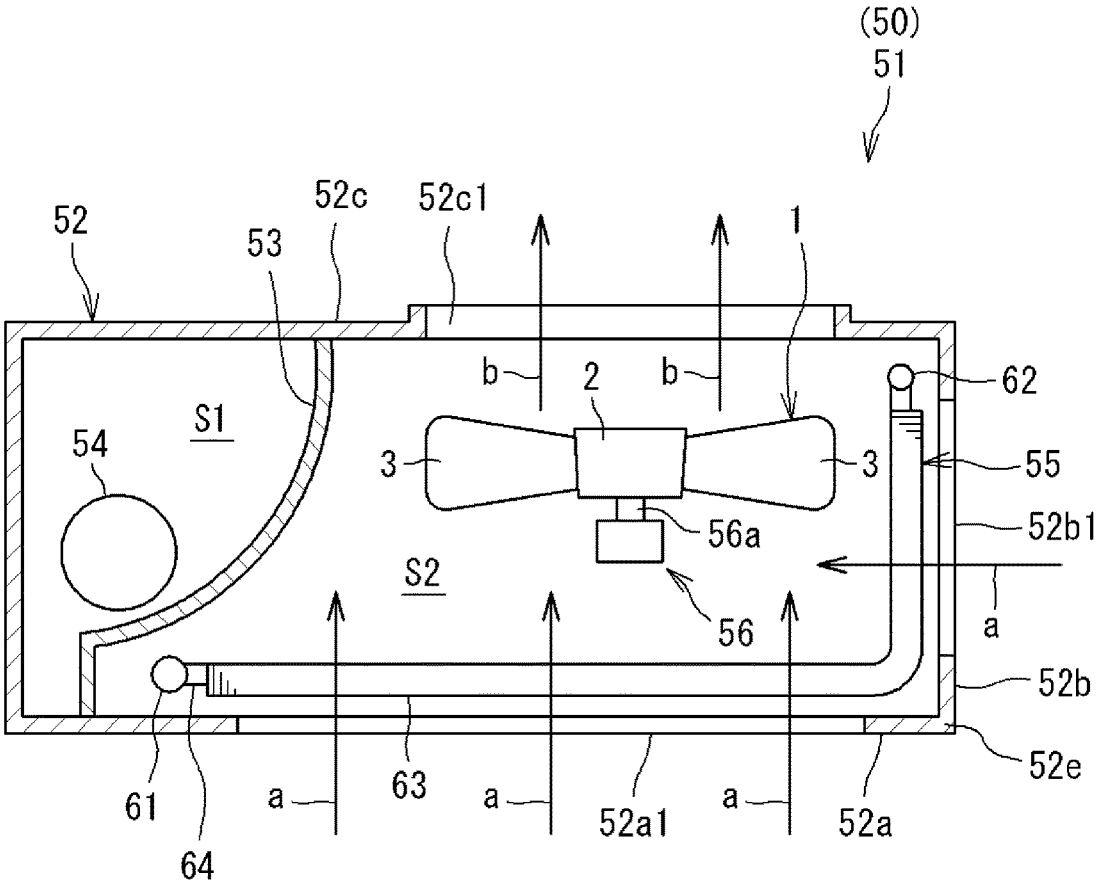
FIG. 8 is a schematic view of an air conditioner according to the present disclosure.

FIG. 8 is a schematic plan view from above, of an interior of an air conditioner 50 as an air conditioner according to an embodiment of the present disclosure. The air conditioner 50 is of a separate type including an outdoor unit and an indoor unit provided separately from each other. The air conditioner 50 according to the present embodiment includes an outdoor unit 51 equipped with the propeller fan 1.

FIG. 8 depicts the outdoor unit 51 constituting the air conditioner 50. The outdoor unit 51 includes a case 52. The case 52 has a rectangular parallelepiped shape, and has a rectangular shape in a planar view. The case 52 has an interior provided with a sectioning wall 53 zoning a machine chamber S1 and a heat exchange chamber S2. The case 52 includes two adjacent side walls 52*a* and 52*b* disposed at the heat exchange chamber S2 and provided with air intake ports 52*a*1 and 52*b*1, respectively. There is further provided a side wall 52*c* disposed adjacent to the side wall 52*b* having the air intake port 52*b*1 and provided with an air blow-out port 52*c*1.

The machine chamber S1 in the case 52 accommodates a compressor 54. The machine chamber S1 accommodates, in addition to the compressor 54, a four-way switching valve, an accumulator, an oil separator, an expansion valve, and the like (not depicted).

The heat exchange chamber S2 in the case 52 accommodates a heat exchanger 55, the fan motor 56, the propeller fan 1, and the like. The propeller fan 1 is connected to the fan motor 56 via the shaft 56*a* so as to be rotationally driven by the fan motor 56.

The propeller fan 1 is disposed to have a posture so as to cause the positive pressure surface 3*a* to face the side wall 52*c* provided with the air blow-out port 52*c*1 and cause the negative pressure surface 3*b* to face the side wall 52*a* provided with the air intake port 52*a*1. When the fan motor 56 is actuated, the propeller fan 1 rotates to import air to the case 52 via the air intake ports 52*a*1 and 52*b*1 and discharge air via the air blow-out port 52*c*1. FIG. 8 includes an arrow a indicating a flow of air imported to the case 52 via the air intake ports 52*a*1 and 52*b*1, and an arrow b indicating a flow of air discharged outside from the case 52 via the air blow-out port 52*c*1.

The heat exchanger 55 has an L shape in a planar view. The heat exchanger 55 is bent near a corner 52*e* between the two side walls 52*a* and 52*b* provided with the air intake ports 52*a*1 and 52*b*1, and is disposed along the two side walls 52*a* and 52*b*.

The heat exchanger 55 includes a pair of headers 61 and 62, fins 63 having plate-shaped surfaces aligned parallelly, and a heat transfer tube 64 penetrating the fins 63 in an alignment direction thereof. The heat transfer tube 64 in the heat exchanger 55 has a flow of a refrigerant circulating in a refrigerant circuit. The heat exchanger 55 is connected with the compressor 54 in the machine chamber S1 via a pipe (not depicted). The machine chamber S1 is provided with a control board (not depicted) configured to control devices equipped in the outdoor unit 51.

As described above, in the air conditioner 50 according to the present embodiment, the outdoor unit 51 includes the propeller fan 1. As described earlier, the propeller fan 1 can improve fan efficiency. The air conditioner 50 can thus have improvement in fan efficiency in the outdoor unit 51. The propeller fan 1 can further achieve reduction in fan noise. The air conditioner 50 can thus have reduction in fan noise in the outdoor unit 51. The outdoor unit 51 includes the propeller fan 1 in the air conditioner 50 according to the present embodiment. Alternatively, the air conditioner according to the present disclosure may exemplarily include the propeller fan 1 provided in the indoor unit (not depicted) in order to supply conditioned air. The air conditioner according to the present disclosure may still alternatively be configured to blow out air upward.

[Action and effects of Embodiment]

(Technical problem)

The propeller fan has eddies generated also at the inner circumferential rear edge radially inside the top of the protrusion. The propeller fan exerts fan efficiency deteriorated due to eddies generated at the inner circumferential rear edge radially inside the top of the protrusion.

It is an object of the present disclosure to improve fan efficiency of a propeller fan including a protrusion tapered and positioned on a rear side in a rotation direction in a radially outer portion of a wing and an air conditioner including the propeller fan.

(Action and effects)

In Embodiment, a propeller fan 1 including a hub 2, and a plurality of wings 3 provided on an outer circumferential surface 24 of the hub 2, in which each of the wings 3 includes a protrusion 35 tapered and positioned on a rear side in a rotation direction in a radially outer portion of the wing 3, the protrusion 35 includes a top 36 positioned at a rearmost end in the rotation direction, an outer circumferential rear edge 37 positioned radially outside the top 36, and an inner circumferential rear edge 38 positioned radially inside the top 36, the outer circumferential rear edge 37 is provided with a first serration shape, and the inner circumferential rear edge 38 is provided with a second serration shape.

In the case where the propeller fan 1 thus configured includes the protrusion 35 tapered and positioned on the rear side in the rotation direction in the radially outer portion of each of the wings 3, this configuration can achieve reduction in size of both eddies generated on the rear side in the rotation direction at the outer circumferential rear edge 37 and the inner circumferential rear edge 38 of the protrusion 35. This enables reduction in level of interference between the eddies Ta and Tb generated on the rear side in the rotation direction of the outer circumferential rear edge 37 and the inner circumferential rear edge 38, to achieve improvement in fan efficiency of the propeller fan 1.

In the propeller fan 1 in Embodiment describe above, a length of a portion provided with the second serration shape is at least 0.5 times and at most 2 times a length of a portion provided with the first serration shape.

The propeller fan 1 thus configured can achieve reduction in size of both the eddies Ta and Tb generated on the rear side in the rotation direction of the outer circumferential rear edge 37 and the inner circumferential rear edge 38 of the protrusion 35.

In the propeller fan 1 in Embodiment describe above, a length of a portion provided with the second serration shape is at least 0.8 times and at most 1.2 times a length of a portion provided with the first serration shape.

The propeller fan 1 thus configured can achieve reduction in size of both the eddies Ta and Tb generated on the rear side in the rotation direction of the outer circumferential rear edge 37 and the inner circumferential rear edge 38 of the protrusion 35.

In the propeller fan 1 in Embodiment describe above, each of the wings 3 includes a bent portion 4 extending in the rotation direction in the radially outer portion of the wing 3, and the top 36 of the protrusion 35 is positioned on a ridgeline 40 of the bent portion 4.

When the propeller fan 1 has the bent portion 4 at the outer circumferential edge 32 of each of the wings 3, this configuration can achieve reduction in size of both the eddies Ta and Tb generated on the rear side in the rotation direction of the outer circumferential rear edge 37 and the inner circumferential rear edge 38 of the protrusion 35.

In Embodiment, an air conditioner 50 including the propeller fan 1.

This configuration can improve fan efficiency of the air conditioner 50.

At least parts of the embodiments described above may be appropriately combined with each other.

The embodiments have been described above. Various modifications to modes and details should be available without departing from the object and the scope of the claims.

REFERENCE SIGNS LIST

1 propeller fan
2 hub
3 wing
31 inner circumferential edge
32 outer circumferential edge
33 front edge
34 rear edge
35 protrusion
36 top
37 outer circumferential rear edge
38 inner circumferential rear edge
41 first serration
42 second serration

The invention claimed is:

1. A propeller fan comprising:
a hub; and
a plurality of wings provided on an outer circumferential surface of the hub, wherein,
each of the wings includes a protrusion tapered and positioned on a rear side in a rotation direction in a radially outer portion of the wing,
the protrusion includes
a top positioned at a rearmost end in the rotation direction,
an outer circumferential rear edge positioned radially outside the top, and
an inner circumferential rear edge positioned radially inside the top,
the outer circumferential rear edge is provided with a first serration shape, and
the inner circumferential rear edge is provided with a second serration shape, wherein
each of the wings includes a bent portion extending in the rotation direction in the radially outer portion of the wing, and the top of the protrusion is positioned on a ridgeline of the bent portion, and the first serration shape and the second serration shape are formed only in the vicinity of the top of the protrusion.

2. The propeller fan according to claim 1, wherein
a length of a portion provided with the second serration shape is at least 0.5 times and at most 2 times a length of a portion provided with the first serration shape.

3. The propeller fan according to claim 1, wherein
a length of a portion provided with the second serration shape is at least 0.8 times and at most 1.2 times a length of a portion provided with the first serration shape.

4. An air conditioner comprising the propeller fan according to claim 1.

* * * * *